US006135336A

United States Patent [19]

Linderoth

[11] Patent Number: 6,135,336

[45] Date of Patent: Oct. 24, 2000

[54] CAPSTAN ARRANGEMENT FOR A CABLE TREATMENT PLANT

[75] Inventor: Gustaf Linderoth, Enköping, Sweden

[73] Assignee: Nextrom Holding S.A., Switzerland

[21] Appl. No.: 09/308,936

[22] PCT Filed: Nov. 28, 1997

[86] PCT No.: PCT/FI97/00736

§ 371 Date: Aug. 5, 1999

§ 102(e) Date: Aug. 5, 1999

[87] PCT Pub. No.: WO98/23522

PCT Pub. Date: Jun. 4, 1998

[30] Foreign Application Priority Data

Nov. 28, 1996 [SE] Sweden ..... 9604386

[51] Int. Cl.[7] ..... B65H 51/10

[52] U.S. Cl. ..... 226/183; 226/108; 226/188; 254/333

[58] Field of Search ..... 226/108, 188, 226/190, 183; 254/333; 242/393

[56] References Cited

U.S. PATENT DOCUMENTS

| | | | |
|---|---|---|---|
| 2,955,731 | 10/1960 | Meinshausen | 226/108 |
| 3,317,149 | 5/1967 | Gooch . | |
| 3,633,809 | 1/1972 | Born | 226/183 |
| 3,777,964 | 12/1973 | Kruner et al. | 226/183 |
| 5,179,892 | 1/1993 | Cicatello et al. | 226/183 |
| 5,497,928 | 3/1996 | Burns et al. | 226/108 |

FOREIGN PATENT DOCUMENTS

| | | |
|---|---|---|
| 0095785 A2 | 12/1983 | European Pat. Off. . |
| 2641265 A1 | 7/1990 | France . |
| 8002756 | 11/1981 | Sweden . |
| 2120692 | 12/1983 | United Kingdom . |

*Primary Examiner*—Katherine A. Matecki
*Attorney, Agent, or Firm*—Nixon & Vanderhye P.C.

[57] ABSTRACT

Capstan arrangement for transporting a cable to a treatment plant, which capstan arrangement comprises a stationary stand, a capstan wheel rotatably mounted on the stand with a peripheral track for the cable and a motor driven driving device in engagement with the capstan wheel for rotating the capstan wheel in relation to the stand. To achieve a play-free rotation of the capstan wheel, the capstan wheel is provided with a co-axial ring-shaped driving flange, whereby the driving device comprises pairs of drive wheels pressing against opposite sides of the driving flange, at least one drive wheel of each pair of drive wheels being motor-driven.

8 Claims, 2 Drawing Sheets

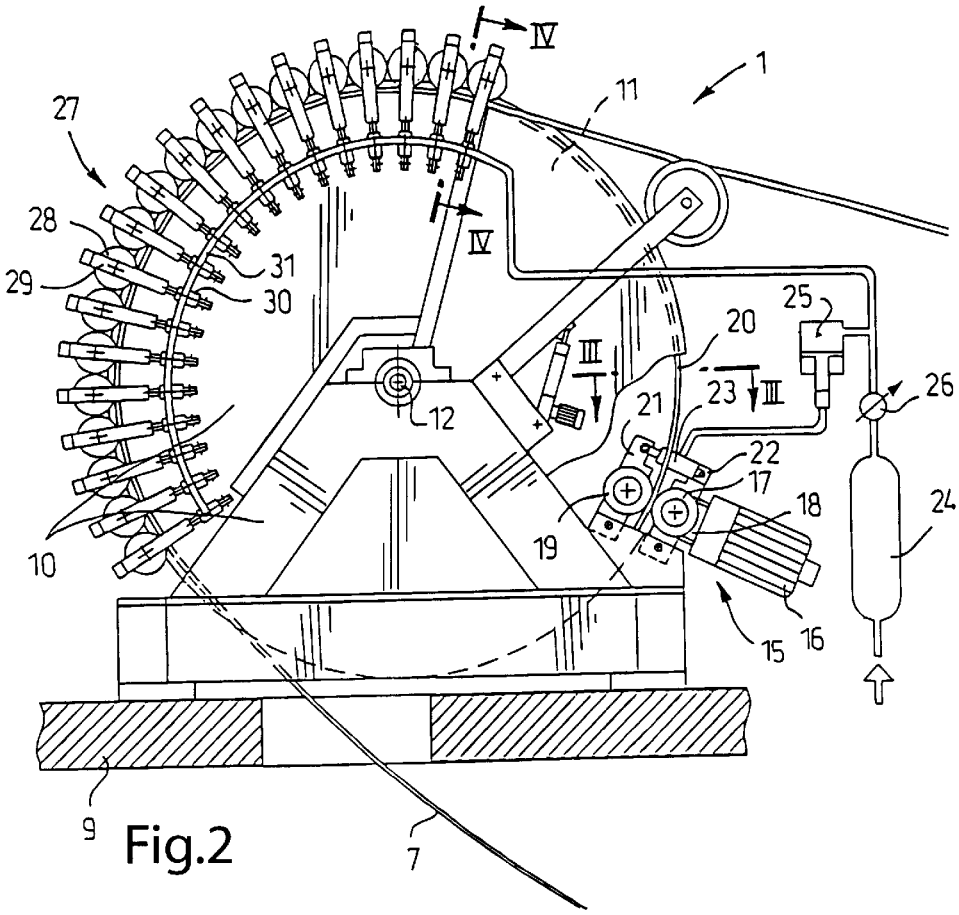
Fig.2
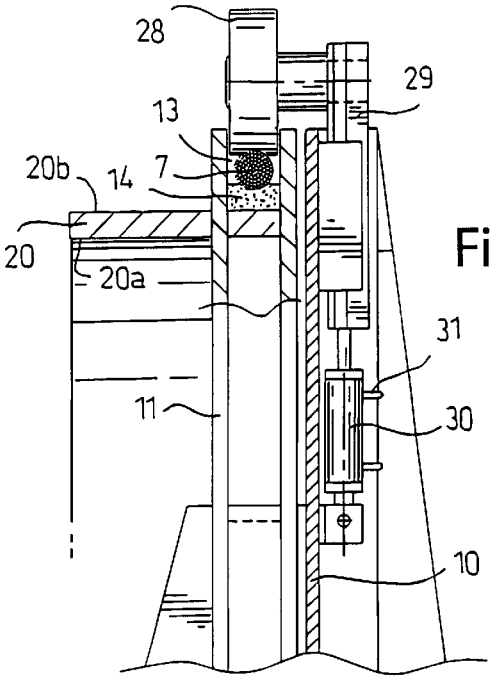
Fig.4
Fig.5
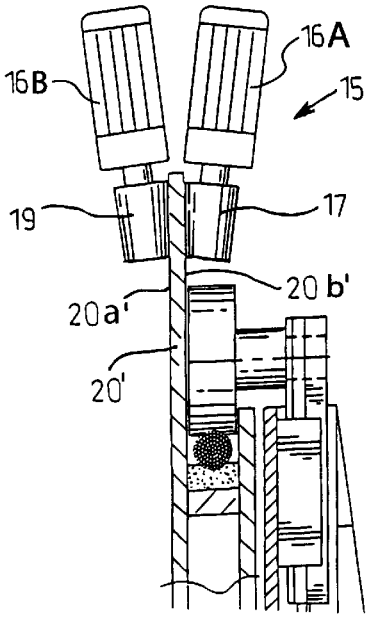

CAPSTAN ARRANGEMENT FOR A CABLE TREATMENT PLANT

FIELD OF THE INVENTION

The present invention relates to a capstan arrangement for transporting a cable or a similar string-shaped product to a treatment plant, which capstan arrangement comprises a stationary stand, a capstan wheel rotatably mounted on the stand, which capstan wheel is provided with a peripheral track for receiving the cable and a motor driven wheel drive in engagement with the capstan wheel so as to rotate the capstan wheel in relation to the stand.

The word 'cable' is in this connection intended to comprise not only finished cables, cords, conductors and other string-shaped products but also semi-finished products of such types at various manufacturing stages.

BACKGROUND

When sheathed cables are manufactured the sheath must after an extrusion of the sheath be vulcanized and cooled in one sequence. For this purpose a vulcanizing pipe and a subsequent cooling pipe are arranged after a plastic extruder through which the metal conductor that is to be sheathed is transported by means of a first capstan arrangement, arranged ahead of the extruder and a second capstan arrangement, arranged after the cooling pipe. At the vulcanizing stage the cable is supported in a horizontal extrusion process solely by the two capstan arrangements, or jointly by the first capstan arrangement, the cooling pipe and the second capstan arrangement. Therefore the cable has a catenary-like path at least in the vulcanizing pipe, whereby at least the vulcanizing pipe also has a catenary design.

To prevent the cable in the vulcanizing pipe to come into contact with the hot vulcanizing pipe it is necessary to keep the cable stretched so between the capstan arrangements that the cable runs through the vulcanizing pipe without coming into contact with it. A contact between the cable and the resistances would inevitably cause damage to the sheath of the cable and the cable would have to be discarded. This puts very great demands on the operation of the capstan arrangements, i.e. it requires that the capstan wheel carries the metal conductor without sliding between the conductor and the capstan wheel, that the stand is as robust as possible and rigidly anchored to the base, that the capstan wheel is firmly mounted in bearings on the stand to minimize the risk of vibrations and oscillations and that the driving engagement between the capstan wheel and the wheel drive for rotating the capstan wheel operates as smoothly and free from play as possible.

In previously known capstans of the above mentioned type the rotation of the capstan wheel is based on a gear ring-gear wheel arrangement between the capstan wheel and the wheel drive. Hereby the capstan wheel is provided with a gear ring with inner or outer teeth, which gear ring is attached to the capstan wheel co-axially with the rotation axis of the capstan wheel and the wheel drive is provided with a motor driven gear wheel with outer teeth, which is supported by the stand. The gear wheel is connected to a motor controlled by a tachometer generator or by a corresponding pulse transducer feedback through a suitable gear change, which motor is controlled via a control unit by a sensor arranged in the vulcanizing pipe for detecting the position of the sheathed cable in the pipe. The capstan arrangement positioned at the outlet end of the cooling pipe is usually operated at a constant speed, so that the position of the cable in the vulcanizing pipe can be adjusted by regulating the rotation of the capstan arrangement positioned ahead of the extruder.

However, practical experience has shown that such a gear driving design, despite a meticulous shaping of the teeth to achieve an engagement without play, causes vibrations in the capstan arrangement and thereby a harmful swinging of the cable in the vulcanizing pipe. This is apparently caused by play occurring all the same in the gear driving due to wear under great strain. It should be noted that the distance between the two capstan arrangements in such a cable vulcanizing line nowadays can be as long as 200 meters, whereby the hanging cable puts great strain on the capstan wheel and the teeth that have to support a tensional force that normally exceeds the weight of the cable. The difficulty of avoiding ovality in the ring-shaped gear ring also causes play variations in the engagement of the teeth and thereby disturbances in the uniform operation of the capstan wheel of the capstan arrangement.

In another known solution the capstan wheel has been totally replaced by a series of rollers aligned close to each other in a semicircular formation, mounted in bearings on a robust stand, over which rollers an inner endless rubber belt is running. An outer endless rubber belt is arranged on the outer side of the semicircular roller track, which belt is running over turning wheels and presses against the roller track in a semicircular formation. The metal conductor, around which a sheath is to be extruded, runs between the inner and outer belt from an unwinding device to an extruder. The speed by which the metal conductor moves into the extruder is regulated by a braking of the turning wheels over which the inner rubber belt is running. By this solution the disadvantage involved in the use of a play inducing gear driving can certainly be avoided, but the braking effect that a capstan wheel with a great peripheral contact angle provides is lost.

A substantial drawback with a capstan arrangement of that design is that the inner rubber belt is exposed to extremely high pressure due to pressure from the rollers and the outer rubber belt, which causes breakage in the inner rubber belt. An additional drawback is that the outer rubber belt easily slides to the side in the roller track and might break as the belt presses against a relatively thick metal conductor in the roller track.

In another design of a capstan arrangement a drawing mechanism in the form of a so called caterpillar is mounted in front of a capstan wheel rotatably mounted in bearings on a robust stand, through which caterpillar the metal conductor is fed. With such a design the braking effect and belt conditions can, however, be improved but space is lost due to the separate caterpillar arrangement, which in itself has teeth play.

In yet another design of a capstan arrangement having a rotatable capstan wheel mounted in bearings on a robust stand the rotation of the capstan wheel is effected via a worm gear mechanism provided with a motor connected to the central axis of the capstan wheel. The gear mechanism is here subjected to considerable momentums and must be very heavily dimensioned and the great play of the gear mechanisms is unavoidable.

SUMMARY OF THE INVENTION

It is an object of the present invention to provide a capstan arrangement where the above mentioned drawbacks are avoided and which makes it possible to utilize a capstan wheel that operates without play and preferably without separate belts in the capstan arrangement. This is achieved by a capstan arrangement that is characterized in that the capstan wheel is provided with a ring-shaped driving flange fixed to the capstan wheel co-axially with the rotating axis of the capstan wheel, and that the wheel drive comprises pairs of drive wheels supported by the stand and pressing against opposite sides of the driving flange, at least one drive wheel of each pair of drive wheels being motor driven.

By the invention a capstan arrangement is achieved where the capstan wheel is running without play with a rolling contact between the capstan wheel and the wheel drive, and a sliding between the driving flange of the capstan wheel and the drive wheels is eliminated by an easily regulated pressing of the drive wheels against the driving flange. Owing to the fact that a capstan wheel can be used with a great peripheral contact angle a non-sliding contact between the drive wheels and the metal conductor can be secured without a need for separate rubber belts.

For such a case where a pressing of the metal conductor against the capstan wheel is desirable a special design for such a pressing device is in accordance with the present invention recommended and it is more closely defined in claim 7. Hereby the capstan wheel of the capstan arrangement and the pressing rollers of the pressing device should be adjustably connected to a pressure medium source so that the drive wheels can be pressed against the driving flange of the capstan wheel with the same force with which the pressing rolls are pressed against the metal conductor.

In the following the invention will be described with reference to the attached drawings.

BRIEF DESCRIPTION OF THE DRAWINGS

FIG. 2 is a front view on a larger scale of an embodiment of the capstan arrangement shown in FIG. 1;

FIG. 4 is a cross-section of the capstan arrangement along line IV—IV in FIG. 2;

FIG. 5 is a cross-section, similar to FIG. 4, of an alternative embodiment of the capstan arrangement.

Figure 1:
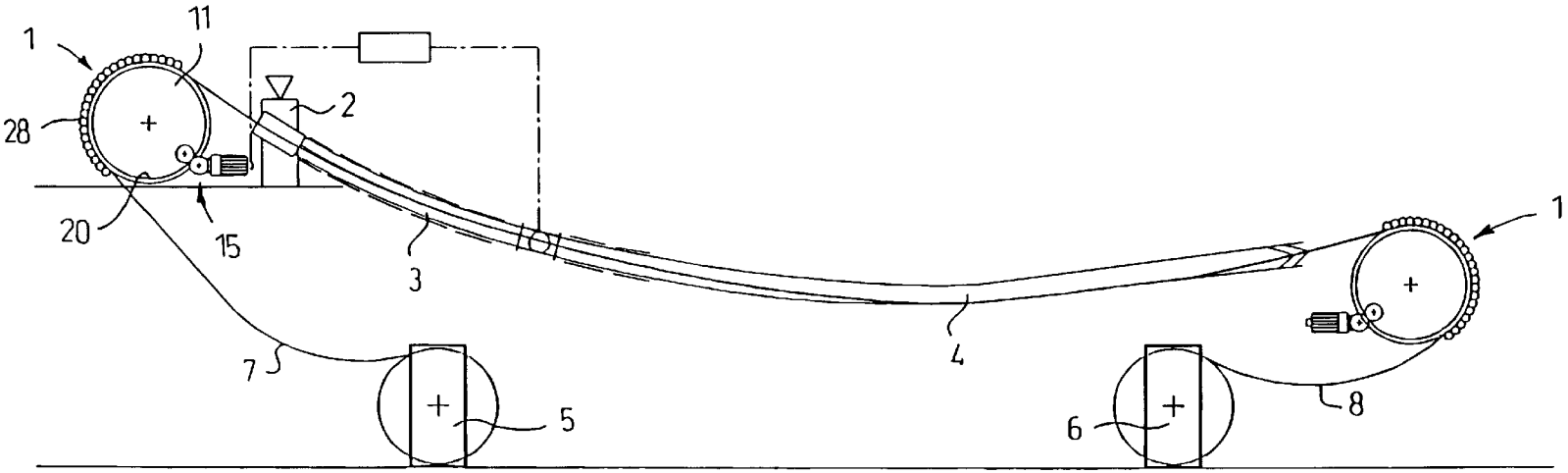
FIG. 1 is a schematic front view of a cable sheathing plant provided with capstan arrangements according to the invention.
Figure 3:
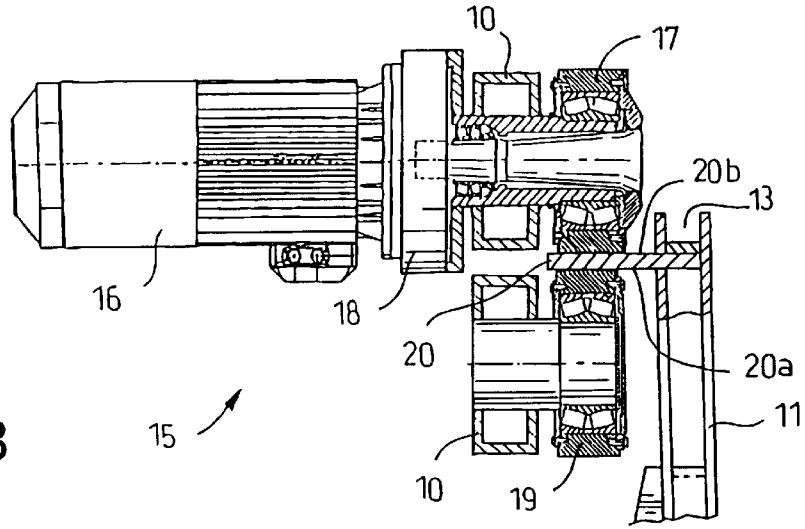
FIG. 3 is a cross-section of the capstan arrangement along line III—III in FIG. 2.

The cable sheathing plant shown in FIG. 1 of the drawings comprises as its main parts two fixedly mounted capstan arrangements 1, a plastic extruder 2, a vulcanization pipe 3 and a cooling pipe, 4 directly connected thereto, an unwinding device 5, and a pick-up device 6. The metal conductor to be sheathed is marked 7 and the sheathed cable marked 8. The design and operation of a plant of this general type is previously well known and will therefore not be discussed further here.

The capstan 1 comprises a robust stand 10 mounted on a base plate and a capstan wheel 11 mounted in the stand, which capstan wheel is rotatable around a horizontal axis 12. The circumference of the sheet-shaped capstan wheel has a driving track 13 with an elastic bottom layer 14 for receiving the metal conductor to be sheathed. To rotate the capstan wheel a wheel drive 15 supported by the stand is provided, which wheel drive comprises a driving motor 16 and a cylindrical drive wheel 17 that is axially parallel with the capstan wheel, which pinion is in engagement with the motor via a gear box 18 without play, and a freely rotating cylindrical mating drive wheel 19 which is axially parallel with the drive wheel 17 and supported by the stand. A driving flange 20 projecting axially from the capstan wheel is rigidly attached to the capstan wheel, whereby the arrangement is such that the driving flange passes between the drive wheels 17, 19. In this way an inner and outer cylindrical track 20*a*, 20*b* is formed for both wheels by the driving flange. The wheel 19 is mounted on a pivotally movable arm 21 in the stand, which arm is connected to a carrier 22 of the drive wheel 17 by pressure medium cylinders 23 that are connected to a pressure medium container 24 via a pressure booster 25 (when required) and a pressure regulator 26.

When the capstan is operating the mating drive wheel 19 is kept pressed by an adjusted pressure against the inner track of the driving flange of the capstan wheel and the drive wheel 17 by the same pressure against the outer track. As the motor is started the capstan wheel 11 is rotated (braked) by the engagement of the drive wheel 17 with the driving flange 20 with a rotating speed adapted to the sheathing circumstances. Usually the capstan wheel of the subsequent capstan arrangement is driven by a constant speed while the capstan wheel of the first capstan arrangement is regulated by adjustment impulses from the sheathing process.

According to an alternative embodiment of the capstan arrangement as shown in FIG. 5 the capstan wheel can be provided with a radially projecting ring-shaped driving flange 20', with which both drive wheel 17, 19 of the wheel drive 15 are in engagement. In this embodiment, both drive wheels 17, 19 are driven by motors 16A, 16B, respectively. The radial, plane, roller tracks are marked 20*a*' and 20*b*'.

In the embodiment shown in FIGS. 2 and 4 the capstan arrangement is further provided with a pressing device 27 that comprises several separate pressing rollers 28 arranged adjacent to each other in the direction of the circumference of the capstan wheel 11, each roller being supported in the stand 10 by a slide 29 that is mounted to slide in a radial direction, so that the circumference of the pressing rollers projects into the capstan wheel track 13. A pressure medium cylinder 30 is arranged between the slide and the stand, which cylinder is connected to the earlier mentioned pressure medium container 24 by a pipe 31. The pressing rollers are arranged in the middle of the stand for that sector of the capstan wheel 11 that reaches from the point where the metal conductor enters the capstan wheel to the point where it leaves the capstan wheel, i.e. where the metal conductor is supported by the bottom of the track.

This embodiment makes it possible to press the metal conductor against the capstan wheel with an extra pressure simultaneously with the pinions 17, 19 being pressed against the driving flange 20 of the capstan wheel with the same pressure, which can be required as greater cable dimensions are being sheathed. The pressing device 27 can, of course, alternately be connected to a pressure medium source by its own independently regulated pipe system. Two pressing rollers can, of course, be arranged to a boggie-type attachment. The pressing rollers provide a pressing effect that is more stable and less prone to disturbances than that of conventional rubber belts.

The cylindrical pinions and mating wheels are preferably of steel with a hardness of the magnitude of 400 HB and the driving flange of the capstan wheel is preferably of flat bar steel of an equivalent hardness. The gear box of the driving motor is preferably of the Cyclo® type, which operates without play with a directly mounted motor. This gear box (for example, Cycle® gear box FCA 75G) is available from Sumimoto Heavy Industries, Ltd.

The description and the related drawings are only intended to illustrate the basic idea of the invention. The capstan arrangement of the invention can vary in its details within the scope of the patent claims. A better regulation of the operation is achieved by a motor-driven pinion but when needed it is also possible to make the mating wheel motor-driven. The capstan arrangement is suited for any use where an exact rotation without play of a capstan wheel for a cable, cord or a similar string-shaped product is required and the invention is not restricted to a sheathing of cables in accordance with a catenary process. The pinions and mating wheels can when so required be provided with a friction increasing coating.

What is claim is:

1. A capstan arrangement for transporting a cable to a treatment plant, the arrangement comprising:

a stationary stand, a capstan wheel rotatably mounted on the stand for rotation about an axis and having a peripheral track for receiving the cable, and a motor driven wheel drive in engagement with the capstan wheel so as to rotate the capstan wheel in relation to the stand, wherein the capstan wheel includes a ring-shaped driving flange arranged co-axially with said axis, and further wherein the wheel drive comprises at least one pair of drive wheels supported by the stand and arranged to press against opposite sides of the driving flange, at least one of said drive wheels being driven by a motor.

2. The capstan arrangement according to claim 1 wherein each drive wheel of said pair of drive wheels is driven by a motor.

3. The capstan arrangement according to claim 1, wherein said at least one drive wheel is connected to said motor through an exchange gear.

4. The capstan arrangement according to claim 1 wherein the driving flange projects axially from the capstan wheel and forms axial cylindrical roller tracks for the drive wheels.

5. The capstan arrangement according to claim 1 wherein the driving flange projects radially from the capstan wheel and forms radial, plane, roller tracks for the drive wheels.

6. The capstan arrangement according to claim 1 wherein at least one drive wheel is mounted on an arm pivotally movable in the stand, said arm connected to a support for the other drive wheel by a pressure medium cylinder for applying an adjustable pressure by drive wheels against the driving flange.

7. The capstan arrangement according to claim 1 and further comprising a pressing device for pressing the cable against the capstan wheel, said pressing device comprising a plurality of pressing rollers arranged adjacent to each other in a direction of the circumference of the capstan wheel, each roller being slidably supported in the stand by a slide such that the pressing roller is positioned radially outside the track of the capstan wheel for the cable, and further wherein each support is connected to a pressure medium cylinder, arranged between the support and the stand, for radial displacement of the pressing roller towards and away from the track.

8. The capstan arrangement according to claim 7 wherein the pressure medium cylinder of the drive wheels and the pressure medium cylinders of the pressing rollers are connected with a pressure medium source by means of a pressure regulator.

* * * * *